US010288029B2

(12) United States Patent
Esteve et al.

(10) Patent No.: US 10,288,029 B2
(45) Date of Patent: May 14, 2019

(54) BATTERY STATE OF FUNCTION PREDICTION WITH WARM/COLD CRANKING RECOGNITION AND SELF-CORRECTION

(71) Applicant: Lear Corporation, Southfield, MI (US)

(72) Inventors: Jose Antonio Canals Esteve, Valls (ES); Antoni Ferre Fabregas, Valls (ES); David Gamez Alari, Valls (ES)

(73) Assignee: Lear Corporation, Southfield, MI (US)

( * ) Notice: Subject to any disclaimer, the term of this patent is extended or adjusted under 35 U.S.C. 154(b) by 59 days.

(21) Appl. No.: 15/606,243

(22) Filed: May 26, 2017

(65) Prior Publication Data

US 2018/0340483 A1 Nov. 29, 2018

(51) Int. Cl.
*F02N 11/08* (2006.01)

(52) U.S. Cl.
CPC ..... *F02N 11/0844* (2013.01)

(58) Field of Classification Search
CPC ... F02D 41/065; F02D 41/064; F02N 11/0844
See application file for complete search history.

(56) References Cited

U.S. PATENT DOCUMENTS 6,885,951 B2 4/2005 Richter
7,593,823 B2 9/2009 Iwane et al.
7,743,649 B1 6/2010 Salman et al.
8,159,228 B2 4/2012 Ferre et al.
8,788,142 B2 7/2014 Aliberti et al.
8,818,611 B2 8/2014 Shin et al.
9,476,947 B2 10/2016 Boehm et al.
2010/0269776 A1* 10/2010 Mizuno ..... F02D 29/06 123/179.4
2016/0216337 A1 7/2016 Milios
2016/0239759 A1 8/2016 Sung
2016/0290270 A1* 10/2016 Sato ..... F02N 11/0825

FOREIGN PATENT DOCUMENTS

WO 2012156603 A1 11/2012

* cited by examiner

*Primary Examiner* — Hung Q Nguyen
*Assistant Examiner* — Xiao En Mo
(74) *Attorney, Agent, or Firm* — Brooks Kushman P.C.

(57) ABSTRACT

A system for a vehicle having an engine and a battery includes a memory and a controller. The memory has a first current expected to be provided by the battery for restarting the engine during a warm cranking event and a second current expected to be provided by the battery for restarting the engine during a cold cranking event. The controller to predict a first minimum voltage of the battery expected during the warm cranking event based on the first current and a second minimum voltage of the battery expected during the cold cranking event based on the second current.

13 Claims, 3 Drawing Sheets

BATTERY STATE OF FUNCTION PREDICTION WITH WARM/COLD CRANKING RECOGNITION AND SELF-CORRECTION

TECHNICAL FIELD

The present invention relates to predicting the State of Function (SoF) of a battery and, more particularly, to predicting the capability of a battery of a vehicle to start an engine of the vehicle in an engine cranking event.

BACKGROUND

The State of Function (SoF) of a battery is a measure of the capability of the battery being able to provide a minimum amount of energy at a given time.

A stop-start system of a vehicle automatically shuts off the engine of the vehicle when the vehicle is at rest, such as at a red traffic light, and automatically restarts the engine when the driver pushes the gas pedal to move the vehicle, such as at the traffic light turning green. Consequently, the amount of time the engine spends idling is reduced, thereby reducing fuel consumption and emissions.

The stop-start system operates a battery of the vehicle to provide electrical power to restart the engine after the engine has been shut off. The electrical power from the battery includes a cranking current to restart (i.e., crank) the engine.

The SoF of the battery is the capability of the battery to start the engine in an engine cranking event. The SoF of the battery should be monitored ahead of the engine being shut off to ensure that the battery will be able to restart the engine. Otherwise, the stop-start system could shut off the engine when the vehicle comes to a stop, such as at a red traffic light, without the battery being able to restart the engine, such as upon the traffic light turning green.

SUMMARY

An object includes predicting the State of Function (SoF) of a battery of a vehicle.

Another object includes predicting the SoF of a battery of a vehicle having a stop-start system.

A further object includes predicting the capability of a battery of a vehicle being able to restart an engine of the vehicle in an engine cranking event.

Another object includes predicting the capability of a battery of a vehicle being able to restart an engine of the vehicle in an engine cranking event including using a self-compensation mechanism.

A further object includes predicting the capability of a battery of a vehicle being able to restart an engine of the vehicle in an engine cranking event including predicting cold and warm cranking currents under variations due to aging of the system (including battery aging), temperature, and other environmental effects.

In carrying out at least one of the above and/or other objects, a system for a vehicle having an engine and a battery is provided. The system includes a memory having a first current expected to be provided by the battery for restarting the engine during a warm cranking event and a second current expected to be provided by the battery for restarting the engine during a cold cranking event. The system further includes a controller to predict a first minimum voltage of the battery expected during the warm cranking event based on the first current and a second minimum voltage of the battery expected during the cold cranking event based on the second current.

The controller may enable the engine to be stopped ahead of a new cranking event when the second minimum voltage of the battery is greater than a minimum voltage threshold and prevent the engine from being stopped ahead of the new cranking event when the second minimum voltage of the battery is less than the minimum voltage threshold. The new cranking event is one of the warm cranking event and the cold cranking event.

The controller may detect a new cranking event as being the warm cranking event as a measured current provided by the battery during the new cranking event is closer to the first current than to the second current, generate a correction factor based on a difference between a measured voltage of the battery during the new cranking event and the first minimum voltage, and predict a third minimum voltage of the battery expected during a next warm cranking event based on the first current and the correction factor. In this case, the controller may enable the engine to be stopped ahead of a subsequent cranking event following the new cranking event when the second minimum voltage of the battery is greater than a minimum voltage threshold and prevent the engine from being stopped ahead of the subsequent cranking event following the new cranking event when the second minimum voltage of the battery is less than the minimum voltage threshold.

The controller may detect a new cranking event as being the cold cranking event as a measured current provided by the battery during the new cranking event is closer to the second current than to the first current, generate a correction factor based on a difference between a measured voltage of the battery during the new cranking event and the second minimum voltage, and predict a fourth minimum voltage of the battery expected during a next cold cranking event based on the second current and the correction factor. In this case, the controller may enable the engine to be stopped ahead of a subsequent cranking event following the new cranking event when the fourth minimum voltage of the battery is greater than a minimum voltage threshold and prevent the engine from being stopped ahead of the subsequent cranking event following the new cranking event when the fourth minimum voltage of the battery is less than the minimum voltage threshold.

The memory may include a warm current profile having the first current and other currents provided by the battery during previous warm cranking events and a cold current profile having the second current and other currents provided by the battery during previous cold cranking events, wherein the first current is a maximum likelihood current of the warm current profile and the second current is a maximum likelihood current of the cold current profile. In this case, the controller may store in the memory with the warm current profile a measured current provided by the battery during the warm cranking event. The maximum likelihood current of the warm current profile is based on the currents of the warm current profile including the measured current provided by the battery during the warm cranking event. The controller may store in the memory with the cold current profile a measured current provided by the battery during the cold cranking event. The maximum likelihood current of the cold current profile is based on the currents of the cold current profile including the measured current provided by the battery during the cold cranking event.

Further, in carrying out at least one of the above and/or other objects, a vehicle having an engine, a battery, a memory, and a controller is provided. The memory has a first current expected to be provided by the battery for restarting the engine during a warm cranking event and a second current expected to be provided by the battery for restarting the engine during a cold cranking event. The controller to predict a first minimum voltage of the battery expected during the warm cranking event based on the first current and a second minimum voltage of the battery expected during the cold cranking event based on the second current.

Also, in carrying out at least one of the above and/or other objects, a method for a vehicle having an engine and a battery is provided. The method includes storing in a memory a first current expected to be provided by the battery for restarting the engine during a warm cranking event and a second current expected to be provided by the battery for restarting the engine during a cold cranking event. The method further includes predicting a first minimum voltage of the battery expected during the warm cranking event based on the first current and a second minimum voltage of the battery expected during the cold cranking event based on the second current. The method further includes enabling the engine to be stopped ahead of a new cranking event when the second minimum voltage of the battery is greater than a minimum voltage threshold, wherein the new cranking event is one of the warm cranking event and the cold cranking event. The method further includes preventing the engine from being stopped ahead of the new cranking event when the second minimum voltage of the battery is less than the minimum voltage threshold.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1A:
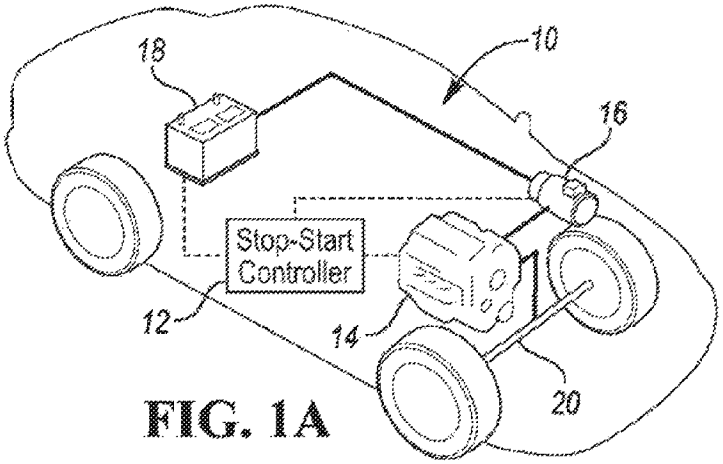
FIG. 1A illustrates a block diagram of an exemplary vehicle having a stop-start system controller, the engine of the vehicle being shut off with the vehicle being stopped.
Figure 1B:
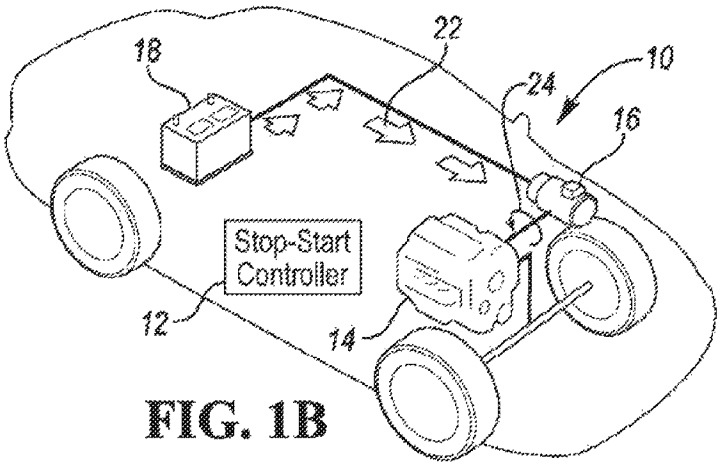
FIG. 1B illustrates a block diagram of the exemplary vehicle, the battery of the vehicle providing power to a starter motor of the vehicle to restart the engine upon the driver pushing the gas pedal to move the vehicle.

Referring now to FIGS. 1A and 1B, block diagrams of an exemplary vehicle 10 having a stop-start system is shown. The stop-start system includes a stop-start system controller 12. Vehicle 10 further includes an engine 14, a starter motor 16, and a battery 18. Engine 14 is configured to generate engine power for driving drive wheels 20. Motor 16 is configured to provide the mechanical power to start or restart engine 14.

Stop-start system controller 12 is configured to automatically shut off engine 14 when vehicle 10 is stopped such as at a red traffic light and it has been evaluated that battery 18 will be able to restart engine 14. Stop-start system controller 12 is further configured to cause battery 18 and motor 16 to operate to automatically restart engine 14 when the driver pushes the gas pedal to move the vehicle such as upon the red traffic light turning green. The operation includes battery 18 providing electrical power having a cranking current to motor 16. Motor 16 converts the electrical power into mechanical power and provides the mechanical power to engine 14 to restart the engine.

In FIG. 1A, stop-start system controller 12 shuts off engine 14 as vehicle 10 is stopped such as at a red traffic light. Engine 14 remains dormant with vehicle 10 at rest.

In FIG. 1B, stop-start system controller 12 operates motor 16 and battery 18 to cause the battery to provide electrical power 22 to the motor for the motor to start engine 14 such as upon the red traffic light turning green. Motor 16 converts electrical power 22 from battery 18 into mechanical power 24 and provides mechanical power 24 to engine 14 to start the engine. Stop-start system controller 12 operates motor 16 and battery 18 to start engine 14 in response to the driver pushing the gas pedal to move vehicle 10.

The State of Function (SoF) of battery 18 may be defined as the capability of the battery to start or restart ("start" and "restart" being used interchangeably herein) engine 14 in an engine cranking event (i.e., during an engine cranking event, as part of the engine cranking event, etc.). As such, the SoF of battery 18 is a measure of the capability of the battery being able to provide sufficient electrical power to motor 16 for starting engine 14.

A battery monitoring system in communication with stop-start system controller 12 is configured to monitor the SoF of battery 18. The battery monitoring system monitors the SoF of battery 18 ahead of shutting off engine 14 to ensure that the battery will be able to restart the engine. The battery monitoring system continuously measures the capability of battery 18 being able to restart engine 14.

This parameter of the capability of battery 18 being able to restart engine 14 is the SoF of the battery. This function is also called "Battery Terminal Voltage Prediction" since the battery monitoring system obtains it by estimating the minimum voltage expected to be present between the two terminals of battery 18 during an engine cranking event. The voltage present between the two terminals of battery 18 is referred to as the "battery terminal voltage." The minimum voltage present between the two terminals of battery 18 is referred to as the "minimum battery terminal voltage."

Two different situations are considered: cold cranking and warm cranking (needed for vehicles with stop-start functionality). "Cranking" refers to battery 18 providing electrical power (i.e., cranking current) to start or restart engine 14. An "engine cranking event" or "cranking event" refers to the occasion or procedure in which a start or restart attempt of engine 14 is conducted because of battery 18 being operated to provide the electrical power for starting or restating the engine. An "engine cold cranking event" refers to an engine cranking event conducted when the engine is cold. An "engine warm cranking event" refers to an engine cranking event conducted when the engine is warm.

If the minimum battery terminal voltage of battery 18 is expected to be below a minimum voltage threshold during an engine cranking event, then the battery will not be able to provide sufficient electrical power to restart engine 14 during the engine cranking event. Therefore, the engine management is informed ahead of engine 14 being shut off and the engine is prevented from being shut off such as when vehicle 10 stops at the next red traffic light.

Conventionally, the capability of battery 18 being able to provide sufficient electrical power for starting engine 14 is estimated by computing the minimum battery terminal voltage of the battery expected during an engine cranking event from a model engine cranking current profile for the engine. The model engine cranking current profile for engine 14 is usually stored in the memory of the battery monitoring system.

Figure 2A:
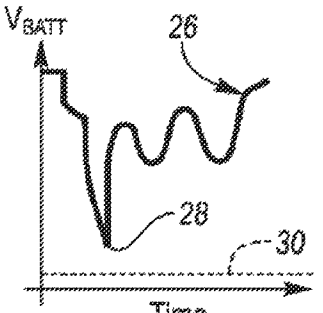
FIGS. 2A, 2B, and 2C each illustrate a respective model engine cranking current profile in the form of a plot of the battery terminal voltage over time during an engine cranking event.
Figure 2B:
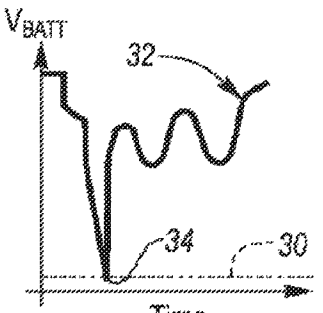
Figure 2C:
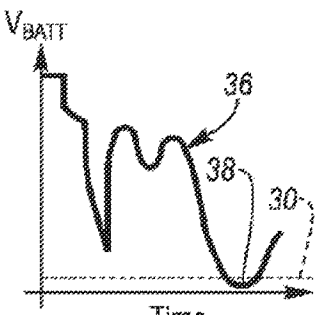

FIGS. 2A, 2B, and 2C each illustrate a respective model engine cranking current profile in the form of a plot of the battery terminal voltage over time during an engine cranking event. In FIG. 2A, battery terminal voltage 26 has a minimum battery terminal voltage 28 during the engine cranking event. Minimum battery terminal voltage 28 is greater than minimum voltage threshold 30. Accordingly, the model engine cranking current profile in FIG. 2A corresponds to a situation where battery 18 is capable to restart engine 14. In FIG. 2B, battery terminal voltage 32 has a minimum battery terminal voltage 34 during the engine cranking event. Minimum battery terminal voltage 34 is equal to minimum voltage threshold 30. Accordingly, the model engine cranking current profile in FIG. 2B corresponds to a situation where battery 18 is not capable of starting engine 14. In FIG. 2C, battery terminal voltage 36 has a minimum battery terminal voltage 38 during the engine cranking event. Minimum battery terminal voltage 38 is less than minimum voltage threshold 30. Accordingly, the model engine cranking current profile in FIG. 2C corresponds to a situation where battery 18 is not capable of starting engine 14.

A problem with using a model engine cranking current profile for engine 14 is that several factors exist which affect the model engine cranking current profile. Vehicles with energy management systems such as start-stop systems typically have two different engine cranking current profiles. The engine cranking current profiles include an engine cold cranking current profile and an engine warm cranking current profile. The engine cold cranking current profile is for normal cranking (cold cranking) engine 14. For instance, the engine cold cranking current profile relates to the cranking current provided for initially starting engine 14 while the engine is cold due to the engine having been turned off for an appreciable length of time such as overnight. The engine warm cranking current profile is for start/stop cranking (warm cranking) engine 14. For instance, the engine warm cranking current profile relates to the cranking current provided for restarting engine 14 while the engine is warm due to the engine having been operated for some length of time. Of course, the engine cold cranking current profile is applicable to start/stop cranking. For instance, the engine cold cranking current profile relates to the cranking current provided for restarting engine 14 while the engine is cold due to the engine having been operated for only a short length of time.

Figure 3:
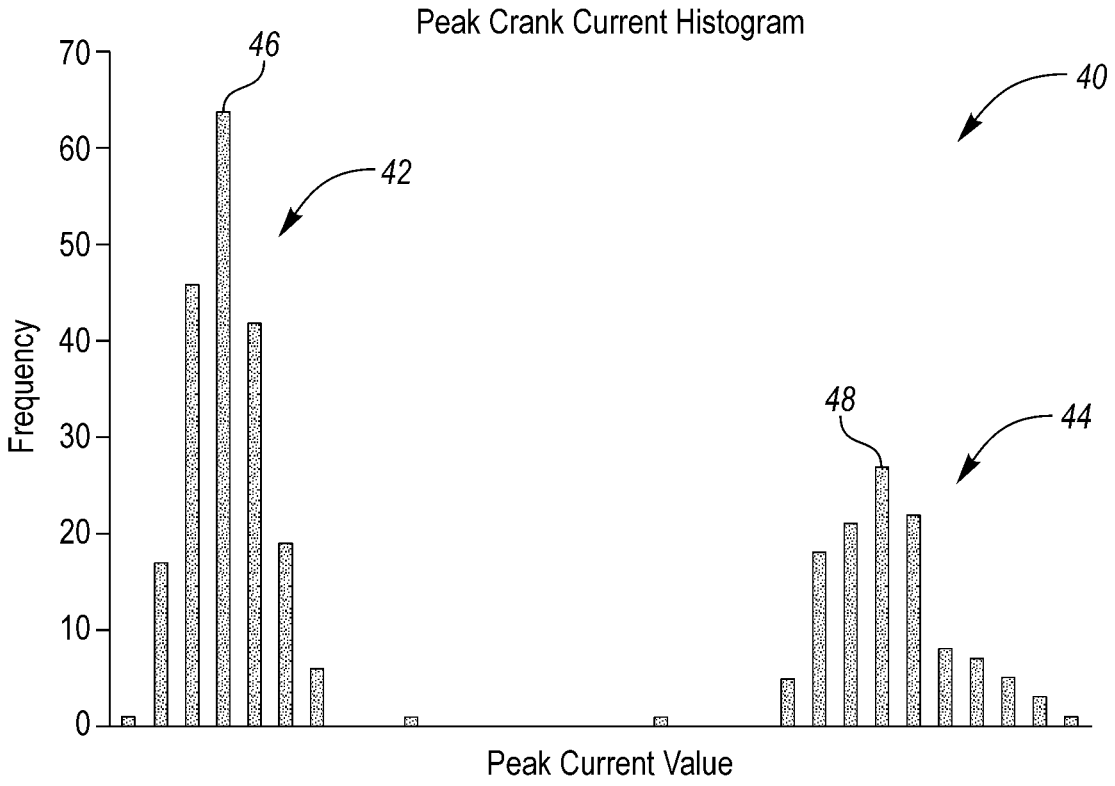
FIG. 3 illustrates a histogram of a distribution of peak values of cranking currents provided by the battery for restarting the engine during engine cranking events.

Referring now to FIG. 3, a histogram 40 of a distribution of peak (i.e., maximum) values of cranking currents provided by battery 18 for restarting engine 14 during engine cranking events is shown. As apparent in FIG. 3, the distribution of the cranking currents of histogram 40 forms an engine warm cranking current profile 42 and an engine cold cranking current profile 44. Engine warm cranking current profile 42 includes a distribution of the peak values of the cranking currents provided by battery 18 for restarting engine 14 during engine warm cranking events. Likewise, engine cold cranking current profile 44 includes a distribution of the peak values of the cranking currents provided by battery 18 for starting (or restarting) engine 14 during engine cold cranking events.

A problem with using a static model of histogram 40 for subsequent engine cranking events is that engine 14 is a physical component operating in a real-world environment as opposed to just being a model. For instance, engine 14, motor 16, and battery 18 all age with time. Peak cranking current depends on temperature and age. Consequently, engine warm cranking current profile 42 and engine cold cranking current profile 44 of the static model of histogram 40 may become inaccurate over time. Engine warm cranking current profile 42 and engine cold cranking current profile 44 will vary throughout the life of engine 14, motor 16, and battery 18 due to aging or temperature. As such, warm cranking current profile 42 and engine cold cranking current profile 44 of the static model of histogram 40 will differ from the real operating status of engine 14.

That is, engine warm cranking current profile 42 and engine cold cranking current profile 44 of the static model of histogram 40 become not representative of the actual cranking currents provided by battery 18 for warm and cold cranking engine 14, respectively, during subsequent engine cranking events. Thus, computing the minimum battery terminal voltage of battery 18 expected during a subsequent engine cranking event (i.e., computing the SoF) using information from engine warm cranking current profile 42 or engine cold cranking current profile 44 of the static model of histogram 40 may lead to stop-start disabling when battery 18 is still capable of starting engine 14 and/or draining the battery too much leaving vehicle 10 stopped without the capability to crank the engine again. The latter case is highly problematic and essentially needs to be completely avoided. Further, although the latter case is clearly worse than the former case, the stop-start system should not be disabled too many times as engine 14 will spend more time idling contrary to the intended benefits of the stop-start system.

Accordingly, a more accurate estimation procedure for estimating the minimum battery terminal voltage of battery 18 expected during an engine cranking event (i.e., estimating the SoF) is desired. Embodiments of the present invention provide enhanced methods and systems with self-learning of warm cranking and cold cranking to estimate the SoF of battery 18 for an engine cranking event (i.e., to estimate the capability of battery 18 being able to start or restart engine 14) based on previous engine cranking events.

Figure 4:
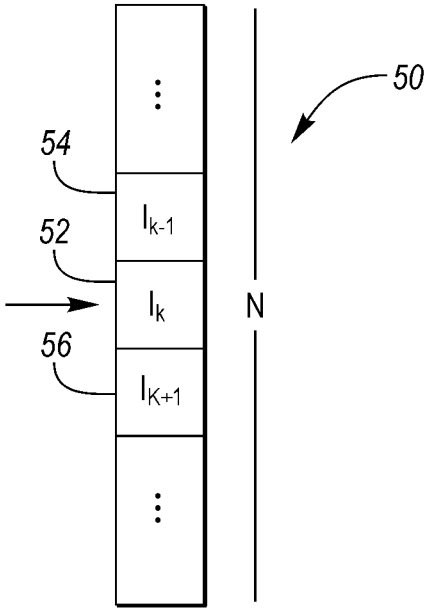
FIG. 4 illustrates a schematic of a N-elements circular buffer having the peak values of the cranking currents for the histogram.

Referring now to FIG. 4, with continual reference to FIG. 3, a schematic of a N-elements circular buffer 50 having the peak values of the cranking currents for histogram 40 is shown. The methods and systems of embodiments of the present invention include measuring the cranking current $I_k$ provided by battery 18 during an engine cranking event occurring at the current time k and storing the peak value of the cranking current $I_k$ in a storage unit 52 of buffer 50. The methods and systems further include measuring the cranking current $I_{k-1}$ provided by battery 18 during the engine cranking event occurring at the immediate previous time k−1 and storing the peak value of the cranking current $I_{k-1}$ in a storage unit 54 of buffer 50. Likewise, the methods and systems further include measuring the cranking currents provided by battery 18 during engine cranking events occurring at previous times and storing the peak values of these cranking currents in respective storage units of buffer 50.

The methods and systems further include using the peak values of the cranking currents stored in buffer 50 to generate histogram 40. That is, at the current time k, the peak values of cranking currents occurring during previous engine cranking events up to the engine cranking event occurring at the current time k are used in generating histogram 40.

The methods and systems continue the process by measuring the cranking current $I_{k+1}$ provided by battery 18 during an engine cranking event subsequently occurring at the immediate next time k+1 and storing the peak value of the cranking current $I_{k+1}$ in a storage unit 56 of buffer 50. At the immediate next time k+1, the peak values of cranking currents occurring during previous cranking events (including the cranking event occurring at the previous current time k) up to the immediate next time k+1 are used in generating histogram 40. As such, histogram 40 is dynamic and is not static.

The distribution in histogram 40 of the peak values of cranking currents stored in buffer 50 is modeled with a probability distribution function based on a mixture of two Gaussians:

$$p(I|\pi_w,\pi_c,\mu_c,\mu_c,\sigma_w^2,\sigma_c^2)=\pi_w N(I|\mu_w,\sigma_w^2)+\pi_c N(I|\mu_c,\sigma_c^2) \quad (1)$$

where $(\pi_w, \pi_c)$ are the partial relative probabilities and $N(I|\mu, \sigma^2)$ is the normal distribution with mean $\mu$ and variance $\sigma^2$.

As described, when a new engine cranking event is detected, the peak value of the measured cranking current is inserted into buffer 50. A recalculation of the probability distribution parameters $(\pi_w,\mu_w,\sigma_w^2,\pi_c,\mu_c,\sigma_c^2)$ (i.e., a recalculation of histogram 40) is then triggered. Several statistical methods can be used to calculate the distribution parameters: non-linear least squares, maximum likelihood estimation, Bayesian inference, etc.

Figure 5:
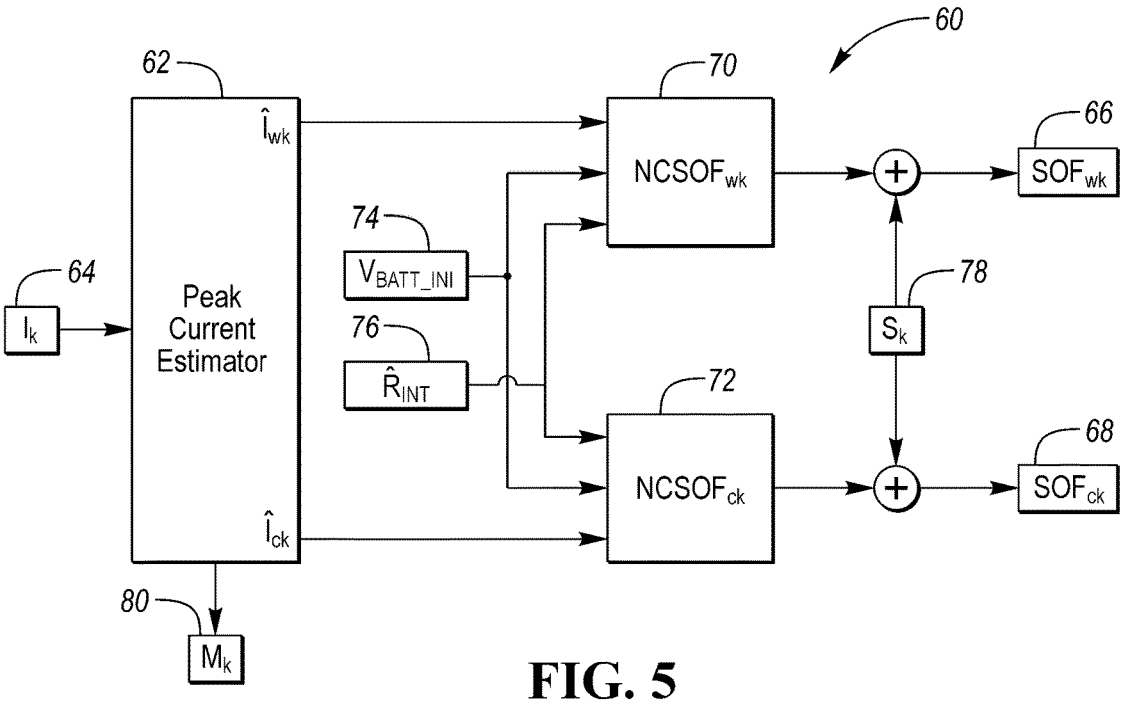
FIG. 5 illustrates a block diagram of a system for predicting the State of Function (SoF) of a battery of a vehicle in accordance with an embodiment of the present invention.

Referring now to FIG. 5, with continual reference to FIGS. 3 and 4, a block diagram of a system 60 for predicting the SoF of battery 18 in accordance with an embodiment of the present invention is shown. System 60 is implemented by a processor of the battery monitoring system. Alternatively, system 60 may be implemented by a processor of some other vehicle controller such as stop-start system controller 12.

System 60 includes a peak current estimator 62. Peak current estimator 62 includes buffer 50. Peak current estimator 62 generates histogram 40 using the peak values of the cranking current stored in buffer 50. Peak current estimator 62 receives peak values of cranking currents as new engine cranking events occur, stores the peak values of these cranking currents in buffer 50, and updates histogram 40 using the peak values of these cranking currents as the peak values of these cranking current are received.

In operation, an engine cranking event occurs at the current time k. Peak current estimator 62 receives the peak value of the cranking current $I_k$ provided by battery 18 during the engine cranking event occurring at the current time k, as indicated at 64.

In turn, system 60 computes (i) a predicted SoF ($SOF_{wk}$, indicated at 66) of battery 18 expected during the next engine warm cranking event and (ii) a predicted SoF ($SOF_{ck}$, indicated at 68) of the battery expected during the next engine cold cranking event. One of the next engine warm cranking event and the next engine cold cranking event is to occur at the immediate next time k+1. The predicted $SOF_{wk}$ is the minimum battery terminal voltage of battery 18 expected during the next engine warm cranking event. The predicted $SOF_{ck}$ is the minimum battery terminal voltage of battery 18 expected during the next engine cold cranking event.

System 60 computes the predicted $SOF_{wk}$ using a predicted peak cranking current ($\hat{I}_{wk}$) (i.e., a predicted peak value of a warm cranking current) expected to be provided from battery 18 for restarting engine 14 during the next engine warm cranking event. Similarly, system 60 computes the predicted $SOF_{ck}$ using a predicted peak cranking current ($\hat{I}_{ck}$) (i.e., a predicted peak value of a cold cranking current) expected to be provided from battery 18 for restarting engine 14 during a next engine cold cranking event.

Peak current estimator 62 generates the predicted peak cranking current ($\hat{I}_{wk}$) expected during the next engine warm cranking event and the predicted peak cranking current ($\hat{I}_{ck}$) expected during the next engine cold cranking event as the mean of the individual probability distributions of the peak values stored in buffer 50 pursuant to the following equations:

$$\hat{I}_{wk}=\mu'_w\ \hat{I}_{ck}=\mu'_c \quad (2)$$

For instance, the predicted peak cranking current ($\hat{I}_{wk}$) expected during the next engine warm cranking event is the most frequent peak cranking current of engine warm cranking current profile 42 of histogram 40. This most frequent peak cranking current of engine warm cranking current profile 42 of histogram 40 is designated with reference numeral 46 in FIG. 3. Similarly, the predicted peak cranking current ($\hat{I}_{ck}$) expected during the next engine cold cranking event is the most frequent peak cranking current of engine cold cranking current profile 44 of histogram 40. This most frequent peak cranking current of engine cold cranking current profile 44 of histogram 40 is designated with reference numeral 48 in FIG. 3.

System 60 initially computes a raw version (i.e., a non-corrected version) of the predicted $SOF_{wk}$ expected during the next engine warm cranking event and a raw version of the predicted $SOF_{ck}$ expected during the next engine cold cranking event pursuant to the following equations:

$$NCSOF_{wk}=V_{BATT_INI}-\hat{R}_{INT}\hat{I}_{wk} \quad (3)$$

$$NCSOF_{ck}=V_{BATT_INI}-\hat{R}_{INT}\hat{I}_{ck} \quad (4)$$

$NCSOF_{wk}$ is the raw (i.e., non-corrected) version of the predicted $SOF_{wk}$ expected during the next engine warm cranking event. That is, $NCSOF_{wk}$ is the raw version of the minimum battery terminal voltage of battery 18 expected during the next engine warm cranking event.

$NCSOF_{ck}$ is the raw (i.e., non-corrected) version of the predicted $SOF_{ck}$ expected during the next engine cold cranking event. That is, $NCSOF_{ck}$ is the raw version of the minimum battery terminal voltage of battery 18 expected during the next engine cold cranking event.

$V_{BATT_INI}$ is the voltage of battery 18 (i.e., the voltage between the terminals of the battery) at the precise moment of the engine start-ability computation is done. If no battery current is flowing and battery 18 is stabilized, then this voltage corresponds to the open circuit voltage of the battery. (More particularly, $V_{BATT_INI}=V_{100}+S\Delta CHG_{MEAS}$, where $V_{100}$ is the voltage of the fully charged battery, $\Delta CHG_{MEAS}$ is the actual amount of charge extracted from the battery, and S is the slope of the open circuit voltage (OCV) versus Discharge (DCHG) map for the battery.)

$R_{BATT_INT}$ is the internal battery resistance of battery 18. (The internal battery resistance may be computed by the method described in U.S. Pat. No. 8,159,228).

$\hat{I}_{wk}$ is the predicted cranking current expected to be provided by battery 18 during the next engine warm cranking event.

$\hat{I}_{ck}$ is the predicted cranking current expected to be provided by battery 18 during the next engine cold cranking event.

System 60 includes a $NCSOF_{wk}$ calculator 70 to calculate the $NCSOF_{wk}$ and a $NCSOF_{ck}$ calculator 72 to calculate the $NCSOF_{ck}$. $NCSOF_{wk}$ calculator 70 and $NCSOF_{ck}$ calculator 72 are implemented by the processor of the controller. $NCSOF_{wk}$ calculator 70 receives the predicted peak cranking current ($\hat{I}_{wk}$) expected during the next engine warm cranking event from peak current estimator 62, a battery voltage value 74 (i.e., $V_{BATT_INI}$), and an internal battery resistance value 76 (i.e., $R_{BATT_INT}$). $NCSOF_{wk}$ calculator 70 plugs the predicted cranking current ($\hat{I}_{wk}$) expected to be provided by battery 18 during the next engine warm cranking event, $V_{BATT_INI}$, and $R_{BATT_INT}$ into the equation (3) to compute the raw version $NCSOF_{wk}$ of the predicted $SOF_{wk}$ expected during the next engine warm cranking event.

Similarly, $NCSOF_{ck}$ calculator 72 receives the predicted peak cranking current ($\hat{I}_{ck}$) expected during the next engine cold cranking event from peak current estimator 62, battery voltage value 74 (i.e., $V_{BATT_INI}$), and internal battery resistance value 76 (i.e., $R_{BATT_INT}$). $NCSOF_{ck}$ calculator 72 plugs the predicted cranking current ($\hat{I}_{ck}$) expected to be provided by battery 18 during the next engine cold cranking event, $V_{BATT_INI}$, and $R_{BATT_INT}$ into the equation (4) to compute the raw version $NCSOF_{ck}$ of the predicted $SOF_{ck}$ expected during the next engine cold cranking event.

In embodiments, a sensed temperature of engine 14 may be considered in generating the predicted $SOF_{wk}$ expected during the next engine warm cranking event and the predicted $SOF_{ck}$ expected during the next engine cold cranking event.

System 60 then computes the predicted $SOF_{wk}$ expected during the next engine warm cranking event and the predicted $SOF_{ck}$ expected during the next engine cold cranking event pursuant to the following equations:

$$SOF_{wk}=NCSOF_{wk}+S_k \tag{5}$$

$$SOF_{ck}=NCSOF_{ck}+S_k \tag{6}$$

$S_k$ is a correction factor, indicated by reference numeral 78 in FIG. 5. The correction factor $S_k$ is added to the raw versions $NCSOF_{wk}$ and $NCSOF_{ck}$ to obtain the compensated versions $SOF_{wk}$ and $SOF_{ck}$ pursuant to the equations (5) and (6). The correction factor $S_k$ is explained more fully with the description of FIG. 6.

System 60 further implements a selection function $M_k$, indicated by reference numeral 80 in FIG. 5. The selection function $M_k$ is defined to equal zero when the peak value of the cranking current $I_k$ is closer to $\hat{I}_{wk}$ than to $\hat{I}_{ck}$; otherwise, the selection function $M_k$ is defined to equal one when the peak value of the cranking current $I_k$ is closer to $\hat{I}_{ck}$ than to $\hat{I}_{wk}$ pursuant to the following equation:

$$M_k = \begin{cases} 0 & |I_k - \hat{I}_{wk}| < |I_k - \hat{I}_{ck}| \\ 1 & |I_k - \hat{I}_{wk}| \geq |I_k - \hat{I}_{ck}| \end{cases} \tag{7}$$

Figure 6:
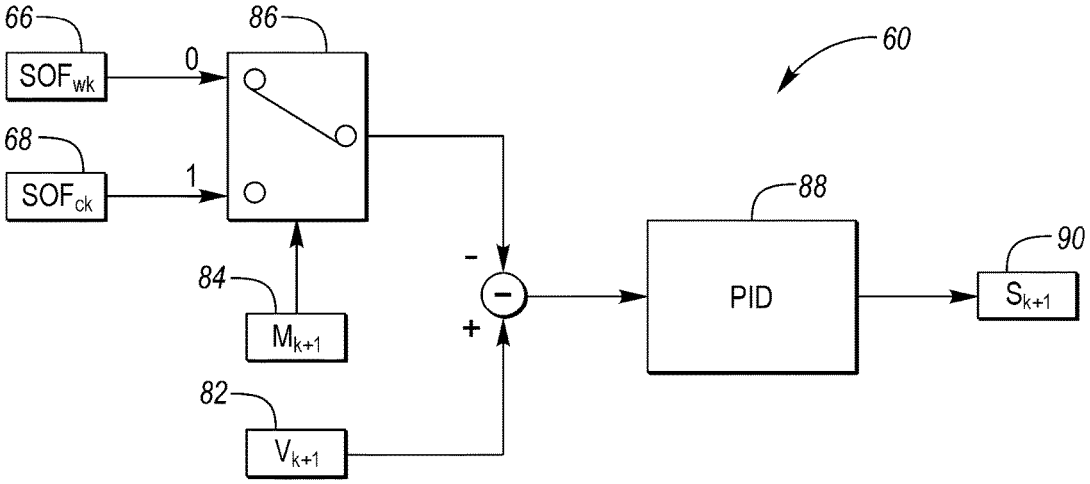
FIG. 6 illustrates a block diagram regarding a correction operation of the system for predicting the SoF of a battery of a vehicle in accordance with an embodiment of the present invention.

The selection function $M_k$ is explained more fully with the description of FIG. 6.

As described, the predicted $SOF_{wk}$ is the minimum battery terminal voltage of battery 18 expected during the next engine warm cranking event and the predicted $SOF_{ck}$ is the minimum battery terminal voltage of the battery expected during the next engine cold cranking event. The predicted $SOF_{wk}$ is greater than the predicted $SOF_{ck}$ as the minimum battery terminal voltage of battery 18 expected during the next engine warm cranking event is greater than the minimum battery terminal voltage of the battery expected during the next engine cold cranking event.

In operation, while the minimum battery terminal voltage of battery 18 expected during the next engine cold cranking event is greater than minimum voltage threshold 30 (shown in FIGS. 2A, 2B, and 2C), stop-start system controller 12 stops engine 14 upon vehicle 10 stopping such as at a red traffic light. In this case, battery 18 is able to restart engine 14 so stop-start system controller 12 stops the engine. Stop-start system controller 12 operates battery 18 and motor 16 to conduct an engine cranking event to restart engine 14 upon the traffic light turning green. The electrical power provided by battery 18 for restarting engine 14 during the engine cranking event includes an actual engine cranking current provided by battery 18 during the engine cranking event.

On the other hand, while the minimum battery terminal voltage of battery expected during the next engine cold cranking event is less than minimum voltage threshold 30, stop-start system controller 12 does not stop engine 14 upon vehicle 10 stopping such as at a red traffic light. In this case, battery 18 is unable to restart engine 14 so stop-start system controller 12 does not stop the engine.

Referring now to FIG. 6, with continual reference to FIG. 5, a block diagram regarding a correction operation of system 60 is shown. When the next engine cranking event at the immediate next time k+1 occurs, a battery monitor associated with system 60 measures the cranking current $I_{k+1}$ provided by battery 18 and the voltage of the battery during this next engine cranking event. The battery monitor determines the peak value of the cranking current $I_{k+1}$ provided by battery 18 during this next engine cranking event. The battery monitor determines the minimum voltage $V_{k+1}$ of the voltage of the battery during this next engine cranking event. The minimum voltage $V_{k+1}$ of the voltage of the battery during this next engine cranking event is indicated by reference numeral 82 in FIG. 6.

In turn, system 60 recalculates the selection function $M_{k+1}$, indicated by reference numeral 84 in FIG. 6. The selection function $M_{k+1}$ is recalculated to be defined to equal zero when the peak value of the cranking current $I_{k+1}$ is closer to $\hat{I}_{wk+1}$ than to $\hat{I}_{ck+1}$; otherwise, the selection function $M_{k+1}$ is recalculated to be defined to equal one when the peak value of the cranking current $I_{k+1}$ is closer to $\hat{I}_{ck+1}$ than to $\hat{I}_{wk+1}$. System 60 further includes a selector 86 which selects one of $SOF_{wk}$ and $SOF_{ck}$ based on the selection function $M_{k+1}$.

System 60 then obtains an error of the prediction (i.e., a difference between (i) the predicted minimum voltage of battery 18 expected during this next engine cranking event (e.g., $SOF_{wk}$ or $SOF_{ck}$) and (ii) the measured minimum voltage of the battery during this next engine cranking event (e.g., $V_{k+1}$)) pursuant to the following equation:

$$E_{k+1} = \begin{cases} V_{k+1} - SOF_{wk} & M_{k+1} = 0 \\ V_{k+1} - SOF_{cw} & M_{k+1} = 1 \end{cases} \tag{8}$$

The predicted error signal $E_{k+1}$ is positive when the measured minimum voltage minimum voltage $V_{k+1}$ during this next engine cranking event is greater than the predicted minimum voltage of battery 18 expected during this next engine cranking event. The predicted minimum voltage of battery 18 expected during this next engine cranking event is (i) $SOF_{wk}$ when this next engine cranking event is an engine warm cranking event or (ii) $SOF_{ck}$ when this next engine cranking event is an engine cold cranking event.

System 60 further includes a discrete PID (proportional—integral—derivative) controller 88. PID controller 88 receives the predicted error signal $E_{k+1}$. PID controller 88 uses the predicted error signal $E_{k+1}$ to generate a new correction factor $S_{k+1}$, indicated by reference numeral 90. The new corrector factor $S_{k+1}$ is to compensate for possible error sources like $V_{BATT_INI}$ or $\hat{R}_{INT}$.

As described, system 60 is configured to calculate an accurate prediction of the battery terminal voltage in a next engine cranking event taking into account warm and cold vehicle conditions. More particularly, system 60 is configured to generate a statistical model of the peak cranking current (e.g., maximum likelihood estimation); analyze and update the model on each engine cranking event; compute two predicted SOF values for warm and cold cranking, respectively; measure the real peak value of the cranking voltage; compare the real peak value of the cranking voltage with the corresponding predicted SOF value; and self-correct to adjust to the quality of the prediction.

Benefits of system 60 include adaptation of the employed algorithm to temperature variations and battery aging; calculation of an accurate prediction of the battery terminal voltage in the next engine cranking event; energy savings and emission reduction due to efficient use of the stop-start system; and battery health monitoring in engine cranking events.

While exemplary embodiments are described above, it is not intended that these embodiments describe all possible forms of the present invention. Rather, the words used in the specification are words of description rather than limitation, and it is understood that various changes may be made without departing from the spirit and scope of the invention. Additionally, the features of various implementing embodiments may be combined to form further embodiments of the present invention.

What is claimed is:

1. A system for a vehicle having an engine and a battery, comprising:

a memory having a first current expected to be provided by the battery for restarting the engine during a warm cranking event and a second current expected to be provided by the battery for restarting the engine during a cold cranking event;

a controller to predict a first minimum voltage of the battery expected during the warm cranking event based on the first current and a second minimum voltage of the battery expected during the cold cranking event based on the second current;

wherein the controller further to detect a new cranking event as being the warm cranking event as a measured current provided by the battery during the new cranking event is closer to the first current than to the second current, generate a correction factor based on a difference between a measured voltage of the battery during the new cranking event and the first minimum voltage, and predict a third minimum voltage of the battery expected during a next warm cranking event based on the first current and the correction factor; and wherein the controller further to enable the engine to be stopped ahead of a subsequent cranking event following the new cranking event when the second minimum voltage of the battery is greater than a minimum voltage threshold and to prevent the engine from being stopped ahead of the subsequent cranking event following the new cranking event when the second minimum voltage of the battery is less than the minimum voltage threshold.

2. The system of claim 1 wherein:

the controller further to detect a second new cranking event as being the cold cranking event as a measured current provided by the battery during the second new cranking event is closer to the second current than to the first current, generate a second correction factor based on a difference between a measured voltage of the battery during the second new cranking event and the second minimum voltage, and predict a fourth minimum voltage of the battery expected during a next cold cranking event based on the second current and the second correction factor.

3. The system of claim 2 wherein:

the controller further to enable the engine to be stopped ahead of a subsequent cranking event following the second new cranking event when the fourth minimum voltage of the battery is greater than a minimum voltage threshold and to prevent the engine from being stopped ahead of the subsequent cranking event following the second new cranking event when the fourth minimum voltage of the battery is less than the minimum voltage threshold.

4. The system of claim 1 wherein:

the memory includes a warm current profile having the first current and other currents provided by the battery during previous warm cranking events and a cold current profile having the second current and other currents provided by the battery during previous cold cranking events, wherein the first current is a maximum likelihood current of the warm current profile and the second current is a maximum likelihood current of the cold current profile.

5. The system of claim 4 wherein:

the controller further to store in the memory with the warm current profile a measured current provided by the battery during the warm cranking event, wherein the maximum likelihood current of the warm current profile is based on the currents of the warm current profile including the measured current provided by the battery during the warm cranking event; and the controller further to store in the memory with the cold current profile a measured current provided by the battery during the cold cranking event, wherein the maximum likelihood current of the cold current profile is based on the currents of the cold current profile including the measured current provided by the battery during the cold cranking event.

6. A vehicle comprising:

an engine;

a battery;

a memory having a first current expected to be provided by the battery for restarting the engine during a warm cranking event and a second current expected to be provided by the battery for restarting the engine during a cold cranking event;

a controller to predict a first minimum voltage of the battery expected during the warm cranking event based on the first current and a second minimum voltage of the battery expected during the cold cranking event based on the second current;

wherein the controller further to detect a new cranking event as being the cold cranking event as a measured current provided by the battery during the new cranking event is closer to the second current than to the first current, generate a correction factor based on a difference between a measured voltage of the battery during the new cranking event and the second minimum voltage, and predict a fourth minimum voltage of the battery expected during a next cold cranking event based on the second current and the correction factor; and wherein the controller further to enable the engine to be stopped ahead of a subsequent cranking event following the new cranking event when the fourth minimum voltage of the battery is greater than a minimum voltage threshold and to prevent the engine from being stopped ahead of the subsequent cranking event following the new cranking event when the fourth minimum voltage of the battery is less than the minimum voltage threshold.

7. The vehicle of claim 6 wherein:

the controller further to detect a second new cranking event as being the warm cranking event as a measured current provided by the battery during the second new cranking event is closer to the first current than to the second current, generate a second correction factor based on a difference between a measured voltage of the battery during the second new cranking event and the first minimum voltage, and predict a third minimum voltage of the battery expected during a next warm cranking event based on the first current and the second correction factor.

8. The vehicle of claim 7 wherein:

the controller further to enable the engine to be stopped ahead of a subsequent cranking event following the second new cranking event when the second minimum voltage of the battery is greater than a minimum voltage threshold and to prevent the engine from being stopped ahead of the subsequent cranking event following the second new cranking event when the second minimum voltage of the battery is less than the minimum voltage threshold.

9. The vehicle of claim 6 wherein:

the memory includes a warm current profile having the first current and other currents provided by the battery during previous warm cranking events and a cold current profile having the second current and other currents provided by the battery during previous cold cranking events, wherein the first current is a maximum likelihood current of the warm current profile and the second current is a maximum likelihood current of the cold current profile.

10. The vehicle of claim 9 wherein:

the controller further to store in the memory with the warm current profile a measured current provided by the battery during the warm cranking event, wherein the maximum likelihood current of the warm current profile is based on the currents of the warm current profile including the measured current provided by the battery during the warm cranking event; and the controller further to store in the memory with the cold current profile a measured current provided by the battery during the cold cranking event, wherein the maximum likelihood current of the cold current profile is based on the currents of the cold current profile including the measured current provided by the battery during the cold cranking event.

11. A method for a vehicle having an engine and a battery, comprising:

storing in a memory a first current expected to be provided by the battery for restarting the engine during a warm cranking event and a second current expected to be provided by the battery for restarting the engine during a cold cranking event;

predicting a first minimum voltage of the battery expected during the warm cranking event based on the first current and a second minimum voltage of the battery expected during the cold cranking event based on the second current;

detecting a new cranking event as being the warm cranking event as a measured current provided by the battery during the new cranking event is closer to the first current than to the second current generating a correction factor based on a difference between a measured voltage of the battery during the new cranking event and the first minimum voltage;

predicting a third minimum voltage of the battery expected during a next warm cranking event based on the first current and the correction factor;

enabling the engine to be stopped ahead of a subsequent cranking event following the new cranking event when the second minimum voltage of the battery is greater than a minimum voltage threshold; and preventing the engine from being stopped ahead of the subsequent cranking event following the new cranking event when the second minimum voltage of the battery is less than the minimum voltage threshold.

12. The method of claim 11 further comprising:

detecting a second new cranking event as being the cold cranking event as a measured current provided by the battery during the second new cranking event is closer to the second current than to the first current;

generating a second correction factor based on a difference between a measured voltage of the battery during the second new cranking event and the second minimum voltage;

predicting a fourth minimum voltage of the battery expected during a next cold cranking event based on the second current and the second correction factor;

enabling the engine to be stopped ahead of a subsequent cranking event following the second new cranking event when the fourth minimum voltage of the battery is greater than a minimum voltage threshold; and preventing the engine from being stopped ahead of the subsequent cranking event following the second new cranking event when the fourth minimum voltage of the battery is less than the minimum voltage threshold.

13. The method of claim 11 further comprising:

storing in the memory a warm current profile having the first current and other currents provided by the battery during previous warm cranking events and a cold current profile having the second current and other currents provided by the battery during previous cold cranking events; and wherein the first current is a maximum likelihood current of the warm current profile and the second current is a maximum likelihood current of the cold current profile.

* * * * *